US005666100A

United States Patent [19]

MacDonald

[11] Patent Number: 5,666,100

[45] Date of Patent: Sep. 9, 1997

[54] LINEAR POTENTIOMETER WITH A FLOATING PIN JOINT

[75] Inventor: Scott A. MacDonald, Framingham, Mass.

[73] Assignee: Data Instruments, Inc., Acton, Mass.

[21] Appl. No.: 529,054

[22] Filed: Sep. 15, 1995

[51] Int. Cl.[6] ..... H01C 1/12

[52] U.S. Cl. ..... 338/202; 338/176; 338/47; 338/98; 338/118; 403/220; 403/229

[58] Field of Search ..... 338/116–119, 98, 338/133, 153, 154, 160, 176, 47, 202; 403/220, 229; 248/529, 594

[56] References Cited

U.S. PATENT DOCUMENTS

| | | | |
|---|---|---|---|
| Re. 31,431 | 10/1983 | Gass | 338/202 |
| 1,359,656 | 11/1920 | Baker | 338/153 |
| 1,621,233 | 3/1927 | Campbell | 338/153 |
| 2,134,197 | 10/1938 | Miller | 403/229 |
| 2,351,734 | 6/1944 | Backe | 403/229 |
| 2,452,033 | 10/1948 | Born | 338/39 |
| 2,528,607 | 11/1950 | Preising et al. | 248/594 |
| 2,634,935 | 4/1953 | Carpenter | 404/229 |
| 3,588,779 | 6/1971 | Goerg | 338/183 |
| 3,639,880 | 2/1972 | Oka | 338/183 |
| 3,887,892 | 6/1975 | Rozema et al. | 338/183 |
| 3,996,550 | 12/1976 | Yano et al. | 338/183 |
| 4,237,443 | 12/1980 | Gass | 338/202 |
| 4,420,273 | 12/1983 | Blessing et al. | 403/24 |
| 4,473,814 | 9/1984 | Blessing | 338/176 |
| 4,680,570 | 7/1987 | Hehl | 338/176 |
| 4,748,434 | 5/1988 | Gass | 338/176 |

FOREIGN PATENT DOCUMENTS

| | | | |
|---|---|---|---|
| 82428 | 11/1956 | Norway | 248/358 |

*Primary Examiner*—Teresa J. Walberg
*Assistant Examiner*—Karl Easthom
*Attorney, Agent, or Firm*—Wolf, Greenfield & Sacks P.C.

[57] ABSTRACT

A floating pin joint is provided for coupling a linear potentiometer to a machine for measuring relative movement between first and second component parts of the machine. The potentiometer has an elongated housing securable to the first component part and a drive actuator slidably attached to the housing. In one embodiment, the floating pin joint includes a bushing, an actuator rod and a spring. The bushing can be positioned in a mounting hole on the drive actuator with an annular bearing surface disposed at one end of the bushing facing outwardly from the mounting hole. The actuator rod has a flange disposed between a first end and second end which contacts the bearing surface when the second end of the rod is extended through the bushing. The spring attaches to the second end of the rod for maintaining the flange in contact with the bearing surface. The first end of the actuator rod can be connected to the second component part of the machine so that movement of the second component part in a predetermined direction causes movement of the drive actuator along the potentiometer in the predetermined direction to result in accurate positional measurements between the component parts of the machine. The floating pin joint reduces or substantially eliminates axial movement within the joint that can introduce measurement errors, while allowing radial, rotational and pivotal movement in the joint.

38 Claims, 4 Drawing Sheets

LINEAR POTENTIOMETER WITH A FLOATING PIN JOINT

BACKGROUND OF THE INVENTION

1. Field of the Invention

The present invention relates generally to potentiometers for measuring the relative movement between two component parts of a process machine. More particularly, the present invention relates to a linear potentiometer having a floating pin joint that reduces or substantially eliminates free play between the potentiometer and the process machine.

2. Discussion of the Related Art

Linear potentiometers are devices that measure the relative movement between component parts of a machine, such as an injection molding machine. In order to provide accurate measurements, the potentiometer should be connected to the machine in such a manner that eliminates free play that could introduce measurement errors when the machine moves in a predetermined direction.

Accurate measurements can be attained using a rigid joint that connects the movable portion of the potentiometer to a component part of the machine so that movement of the machine in a predetermined direction is transmitted without free play to the potentiometer. A disadvantage associated with using a rigid joint is the relatively rapid destruction of the potentiometer caused by such things as machine vibrations and misalignment, which result in a continuously increasing measurement error.

One way of reducing measurement error caused by the destructive effect from using a rigid joint is to use a non-rigid coupling that can withstand such vibrations and misalignment. A disadvantage with a non-rigid coupling, however, is inaccurate measurements resulting from the free play present in the joint introduced by tolerances between various parts that make up the coupling. The free play allows the component part of the machine to move without being measured by the potentiometer.

Potentiometer couplings have been developed that attempt to eliminate the free play in the direction of measurement within the joint, while at the same time allowing the joint to radially float and pivot so as to avoid the destructive effect experienced by rigid joints. Some joints use a ball-type joint formed at one end of a connecting shaft that is biased to abut a joint plate. Biasing the connecting shaft so that the ball-type joint maintains contact with the joint plate reduces the free play in the travel direction resulting in accurate measurements in that direction.

Examples of play-free joints that can be used with linear potentiometers are shown in U.S. Pat. Nos. 4,420,273 and 4,680,570. Each patent discloses a coupling that includes a connecting member that has a ball-shaped end that is biased against a plate or jewel bearing to reduce free play in a desired direction of travel. The connecting member, however, can move in other directions without impacting the accuracy of the positional measurements. In the '273 patent, the ball-shaped connecting member is secured between planar abutments that can be flat ground sapphire stones. In the '570 patent, one end of the connecting member is spherically shaped and is biased against a hardened contact or joint plate that can be made from a metal material. These joints, however, have disadvantages of their own that include higher costs associated with producing connecting members with ball or spherically shaped ends and sapphire stone abutments. Additionally, jewel bearings can dislodge from their positions causing a change in the reference plane, rough operation of the actuator pin, and potentially damaging a potentiometer.

SUMMARY OF THE INVENTION

In one illustrative embodiment of the invention, a floating pin joint is provided for coupling a first member to a second member so that movement of the first member in a predetermined direction causes movement of the second member in the predetermined direction. The features of the floating pin joint include a bushing that has an annular bearing surface, an actuator rod that has a flange disposed between each end, and biasing means for maintaining the flange in contact with the bearing surface. The bushing is positioned in a mounting hole provided on the second member so that the bearing surface faces outwardly from the second member. One end of the actuator rod extends through the bushing so that the flange contacts the bearing surface with the biasing means attached to the end of the rod that extends through the bushing.

According to another illustrative embodiment of the invention, a floating pin joint is provided for connecting a linear potentiometer between two component parts of a machine. The potentiometer includes an elongated housing securable to a first component part of the machine and a drive actuator slidably attached to the housing. The drive actuator has a wall with a mounting hole extending between its front surface and rear surface for mounting the floating pin joint. The drive actuator is connectable to a second component part of the machine through the floating pin joint and is slidable along the housing in response to movement of the second component part relative to the first component part in predetermined direction.

In this illustrative embodiment, the features of the floating pin joint include a bushing positioned in the mounting hole, an actuator rod extending through the bushing, a spring and a retainer. The bushing has an annular bearing surface adjacent the front surface of the wall with the bearing surface facing outwardly from the wall. The actuator rod has a first end, a second end and a flange disposed between the first and second ends that contacts the bearing surface when the second end is extended through the bushing. The spring is coaxially positioned between the flange and the second end of the actuator rod with a first end that engages the rear surface of the wall surrounding the mounting hole. The retainer attaches to the second end of the actuator rod and compresses the spring so that the spring urges the flange into contact with the bearing surface.

According to a further illustrative embodiment of the invention, a linear potentiometer is provided for measuring the relative movement between first and second component parts. The features of the linear potentiometer include an elongated housing that is securable to the first component part, a resistive element mounted in the housing, a wiper carrier that has a wiper for slidably engaging the resistive element, an actuator drive housing connected to the wiper carrier, and a floating pin joint mounted to the actuator drive housing. The elongated housing has a longitudinal slot disposed on a wall of the housing and a longitudinal guide disposed in the housing. The wiper carrier has a shoe disposed on each end that slidably engages the guide in the housing, and an upper portion that extends from the housing through the slot for attaching the actuator drive housing.

The floating pin joint in this illustrative embodiment includes a bushing that is positioned in a mounting hole on the actuator drive housing, an actuator rod that extends through the bushing, and biasing means attached to one end of the actuator rod. The bushing has an annular bearing surface disposed on one end that faces outwardly from the actuator drive housing. The actuator rod has a first end, a second end and a flange disposed between the first and second ends that contacts the bearing surface. The biasing means attach to the second end of the actuator rod and maintain the flange in contact with the bearing surface. The first end of the actuator rod can connect to the second component part so that movement of the second component part in a predetermined direction causes movement of the wiper carrier along the housing.

One advantage of the illustrative embodiments is a less complex floating pin joint that reduces manufacturing costs and is easier to assemble. A further advantage is eliminating problems associated with dislodged jewel bearings.

Numerous other features and advantages of the invention will become apparent upon a reading of the following detailed description taken in conjunction with the accompanying drawings.

DETAILED DESCRIPTION

Figure 1:
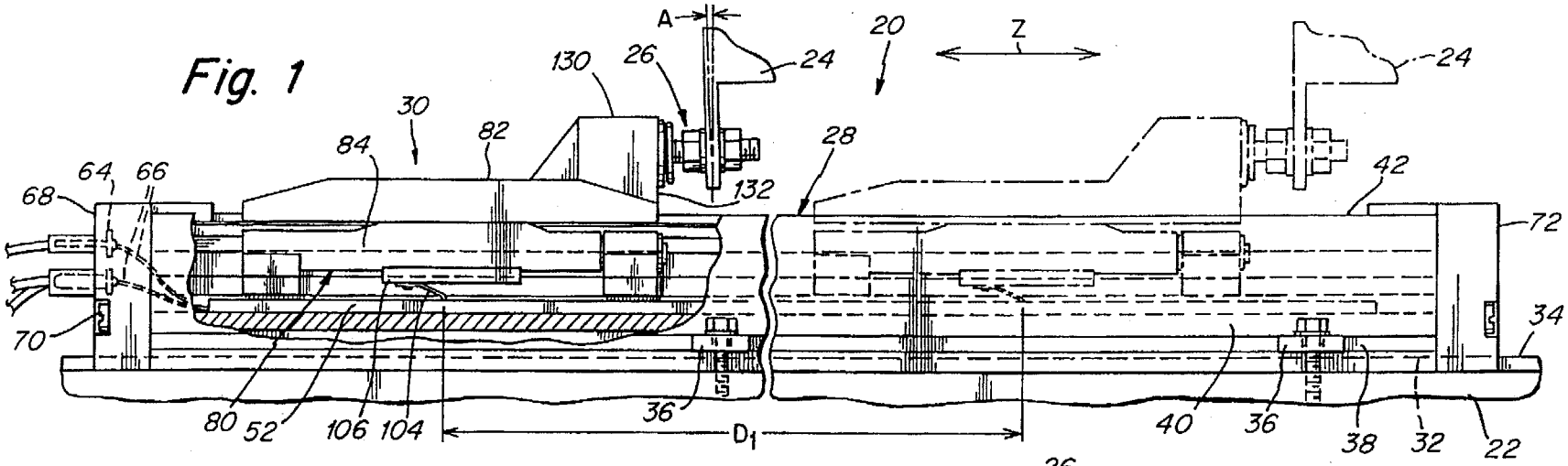
FIG. 1 is a partially fragmented, side elevational view illustrating the linear potentiometer mounted on a machine.
Figure 2:
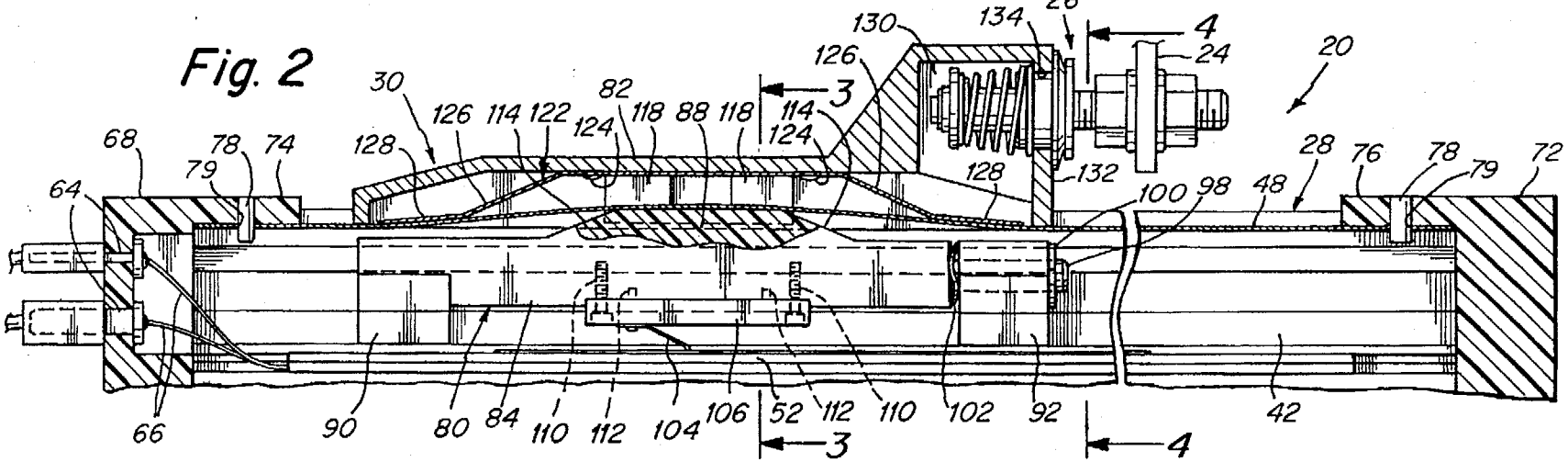
FIG. 2 is an enlarged, cross-sectional side view of the linear potentiometer similar to FIG. 1.

The present invention includes a linear potentiometer for measuring the relative movement between two component parts of a machine, such as an injection molding or other types of process machines. As shown in FIGS. 1 and 2, the potentiometer, generally shown as 20, is secured to a first component part 22 of a machine and is coupled to a second component part 24 of the machine using a floating pin joint 26 that reduces or substantially eliminates free play in the Z direction resulting in more accurate positional measurements. At the same time, the joint 26 can radially float in the X and Y directions (FIG. 4), rotate R (FIG. 4) or pivot A (FIG. 6) without impacting the accuracy of the measurements. The radial and pivoting movements of the joint 26 make allowance for tolerance build-up, machine vibrations, machine misalignment, etc. The concept of a play-free joint refers to a joint that reduces or substantially eliminates joint movement in the axial Z direction, generally created by part tolerances, that could result in inaccurate positional measurements.

In an illustrative embodiment of the invention as shown in FIGS. 1 and 2, the potentiometer 20 is comprised of two major components, namely, a housing assembly 28 and an actuator drive assembly 30 that is slidably attached to the housing assembly 28. The housing assembly 28 is secured to the first component part 22 using a series of clamps 36 that are spaced along the length of the housing assembly 28 and engage a clamp recess 38 disposed on each side 40 of the housing assembly 28. An alignment recess 32 provided along the length of the bottom of the housing assembly 28 engages a corresponding key 34 on the first component part 22 to properly align the potentiometer 20 on the machine.

The housing assembly 28 includes an elongated housing 42 which has a longitudinal slot 44 that is centrally located through its top wall 46 and extends the length of the housing 42 along which the actuator drive assembly 30 travels. As a barrier against the infiltration of foreign matter into the housing 42, a metal strip 48 is placed over the slot 44 and retained in place with magnetic strips 50 disposed along each side of the slot 44. Preferably, the housing 42 is an aluminum extrusion that can be manufactured in any number of lengths depending upon the particular application for the potentiometer 20.

A resistive element 52 is mounted in the housing 42 below the slot 44. Similar to the housing 42, the resistive element 52 can be supplied in various lengths to accommodate particular potentiometer applications.

As illustrated in FIGS. 1 and 2, the resistive element 52 is connected to electrical contacts 64 using electrical wire 66. The electrical contacts 64 extend through a connector end cap 68 which attaches to one end of the housing 42 using fasteners 70 (e.g., screws). The electrical contacts 64 can be attached to the end cap 68 in a number of ways including molding, press-fitting, fastening, etc. The opposite end of the housing 42 is closed off with an end cap 72 that is similar to the connector end cap 68, with the exception that it does not contain the electrical contacts 64.

As shown in FIG. 2, the end caps 68, 72 also retain the metal strip 48 in position over the slot 44. The top wall 74, 76 of each end cap 68, 72 extends over the housing top wall 46 to cover each end of the metal strip 48. A fastener 78, such as a pin, is inserted through each end cap top wall 74, 76 so that a portion of the pin 78 protrudes below the top wall 74, 76 and engages a hole 79 (FIG. 7) in each end of the metal strip 48. The top walls 74, 76 prevent the ends of the metal strip 48 from lifting off the ends of the housing 42, while the pins 78 prevent the ends of the metal strip 48 from being pulled out from beneath the end cap top walls 74, 78.

As illustrated in FIGS. 1–4, the actuator drive assembly 30 includes a carrier block 80, a cover 82 and the floating pin joint 26. The carrier block 80 includes a sled 84 that slides within the housing 42, a platform 86 that lies above and generally parallel to the top wall of the housing 42 and an upper extension 88 that connects the platform 86 to the sled 84. The upper extension 88 extends through and travels along the slot 44 in response to movement of the second component part 24. Preferably, the carrier block 80 is molded from a plastic material, such as lubricated, glass-reinforced polyphenylene sulfide (PPS).

Figure 3:
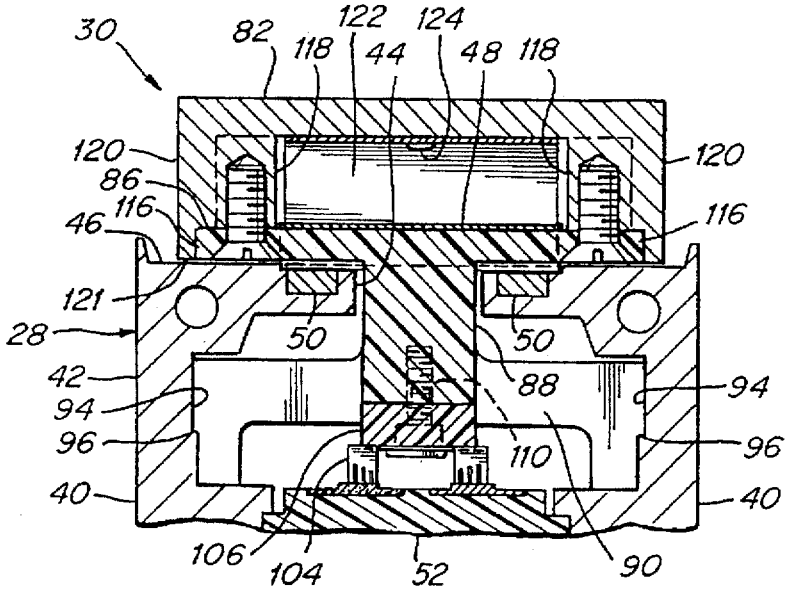
FIG. 3 is an enlarged cross-sectional view taken along section line 3—3 of FIG. 2.
Figure 4:
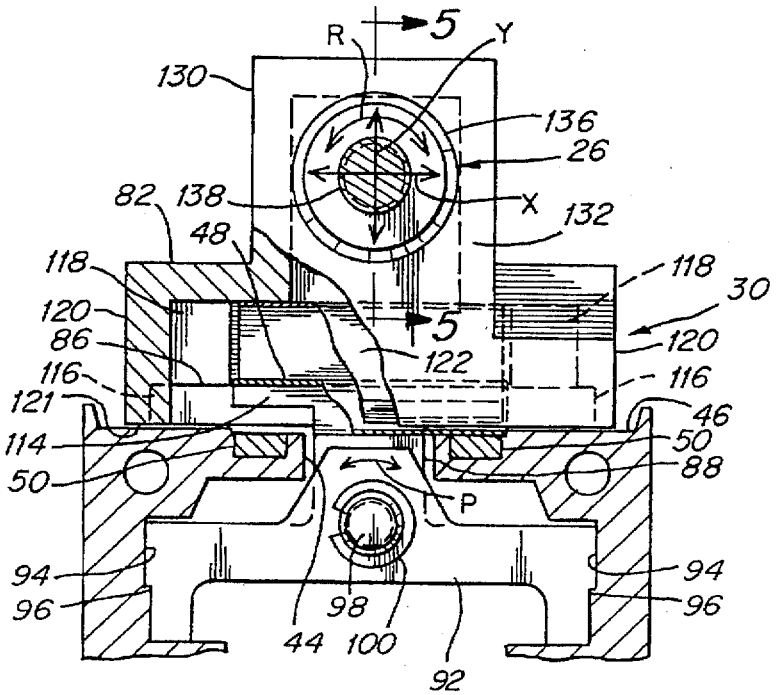
FIG. 4 is a partial cross-sectional view taken along section line 4—4 of FIG. 2.

The sled 84 includes a fixed shoe 90 at on end and a pivoting shoe 92 at the opposite end that engage generally C-shaped internal guides 94 disposed above the channels 56 within the housing 42. The shoes 90, 92 are inverted generally U-shaped members that are formed to maintain close dimensional tolerances with respect to the guides 94 in order to minimize the amount of float between the actuator drive assembly 30 and the housing assembly 28. As shown in FIGS. 3 and 4, each shoe 90, 92 has stepped side walls 96 that establish two separate widths for each shoe and match a similar step in each guide 94 of the housing 42. The stepped side walls 96 create a fitted feature that limits the tendency of the shoes 90, 92 to rotate within the guides 94. The combination of the fixed shoe 90 and the pivoting shoe 92 is advantageous over a configuration in which both shoes are fixed because the housing 42 may have a tendency to twist as its length increases. The use of the pivoting shoe 92 can reduce the chance that the actuator drive assembly 30 will bind as it slides along the length of the housing assembly 28 when twist is present in the housing 42.

As shown in FIGS. 2 and 4, the pivoting shoe 92 pivots P on a shaft 98 that extends axially from the end of the sled 84 opposite the fixed shoe 90. The pivoting shoe 92 is secured to the shaft 98 using a fastener such as a retaining ring 100 that snaps onto the free end of the shaft 98. To minimize free play between the pivoting shoe 92 and the sled 84, biasing means 102 such as a wave washer is disposed between the pivoting shoe 92 and the sled 84 to bias the pivoting shoe against the retaining ring 100. The shaft 98 is preferably molded into the carrier block 80, but it can also be inserted using other known methods, such as press fitting or threading the shaft 98 into a hole in the carrier block 80, or ultrasonically joining the shaft 98 to the carrier block 80.

As illustrated in FIGS. 2 and 3, positional measurements are achieved using a wiper 104 that extends downwardly at an angle from the sled 84 to engage the resistive element 52 as the actuator drive assembly 30 slides along the housing assembly 28. The wiper 104 is attached to a wiper block 106 which is removably mounted to the sled 84 using fasteners 110, such as screws, that are recessed into the wiper block 106 to avoid contact between the fasteners 110 and the resistive element 52. The wiper block 106 includes locating pins, 112 protruding from its upper surface that engage corresponding holes in the bottom of the sled 84 to properly align the wiper block 106 on the carrier block 80. Although the wiper 104 could be attached directly to the sled 84, the use of the wiper block 106 is advantageous because it provides an easier and more economical means for replacing a damaged wiper 104.

As shown in FIG. 1, the actuator drive assembly 30 slides along the length of the housing assembly 28 in response to the translational movement of the second component part 24 in the Z direction relative to the first component part 22. As the wiper 104 translates a distance D1 along the resistive element 52, electrical signals are produced at the electrical contacts 64 that can be converted into accurate positional measurements using means generally known in the art.

Referring to FIGS. 2–4, the platform 86 lies generally parallel and in close proximity to the top wall 46 of the housing 42 above the slot 44. The metal strip 48 rides over the platform 86 as the actuator drive assembly 30 slides along the housing assembly 28. Ramps 114 formed on the front and rear edges of the platform 86 guide the metal strip 48 over the platform 86. The ramps 114 continue downwardly from the platform 86 and form the transition from the platform 86 to the sled 84 constituting the upper extension 88. The platform 86 should have a width that extends beyond the width of the metal strip 48 to provide mounting ears 116 for connecting the cover 82 to the carrier block 80.

The cover 82 is a low-profile, generally rectangular structure having an inverted, generally U-shaped cross-section. The mounting ears 116 attach to mounting bosses 118 that depend downwardly from the top wall of the cover 82 adjacent the cover side walls 120. As shown in FIGS. 3–4, the mounting bosses 118 are recessed within the cover 82 so that the platform 86 is mounted within the cover 82 maintaining a minimal clearance between the bottom edge 121 of the cover 82 and the top wall 46 of the housing 42. Preferably, the cover 82 is formed from an aluminum alloy using a die casting process.

As illustrated in FIGS. 2–4, a tension spring 122 attaches to the underside of the cover 82 and downwardly depends to engage the metal strip 48 on both sides or the platform ramps 114. In the illustrative embodiment, the tension spring 122 is attached to the cover 82 by placing the tension spring 122 on mounting pins (not shown) that protrude downwardly from the cover 82. The mounting pins are then deformed in a manner similar to a rivet so that enlarged heads 124 are formed to retain the tension spring 122 on the cover 82. Each end of the tension spring 122 has a leg 126 that is angled downwardly from the cover 82 to be approximately parallel to the ramps 114. Cantilevered from the end of each leg 126 is a foot 128 that is also angled downwardly from the cover 82, but at an angle less than the angle of each leg 126. Each foot 128 engages the metal strip 48 on each side of the platform 114 and applies a downward force to ensure that the metal strip 48 remains properly seated over the slot 44 as the actuator drive assembly 30 slides along the housing assembly 28. In the illustrative embodiment, each leg 126 is angled downwardly approximately 20° degrees and each foot 128 is angled downwardly approximately 5° from a horizontal plane. Preferably, the tension spring 122 is made from a sheet of stainless steel having a spring temper and is finished with a teflon coating that reduces the friction between the tension spring 122 and the metal strip 48.

Figure 7:
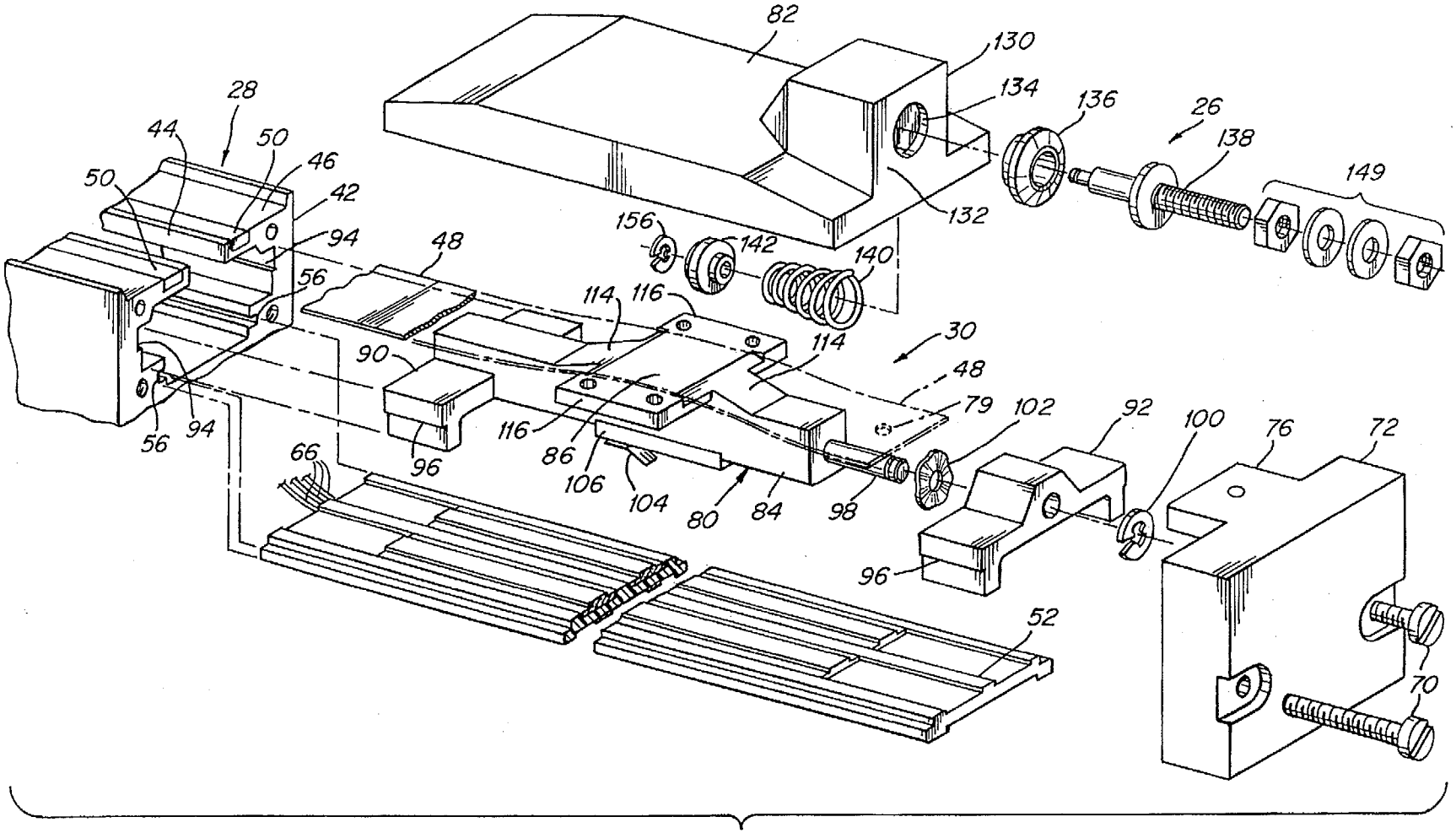
FIG. 7 is an exploded perspective view of an embodiment of the linear potentiometer of the present invention.

As shown in FIGS. 2 and 7, the end of the cover 82 overlying the pivoting shoe 92 includes a chamber 130 for housing the floating pin joint 26. The front wall 132 of the chamber 130 has a mounting hole 134 through which is mounted the floating pin joint 26. The chamber 130 should be configured so that the floating pin joint 26 can float and pivot without being restricted by the chamber walls.

Figure 5:
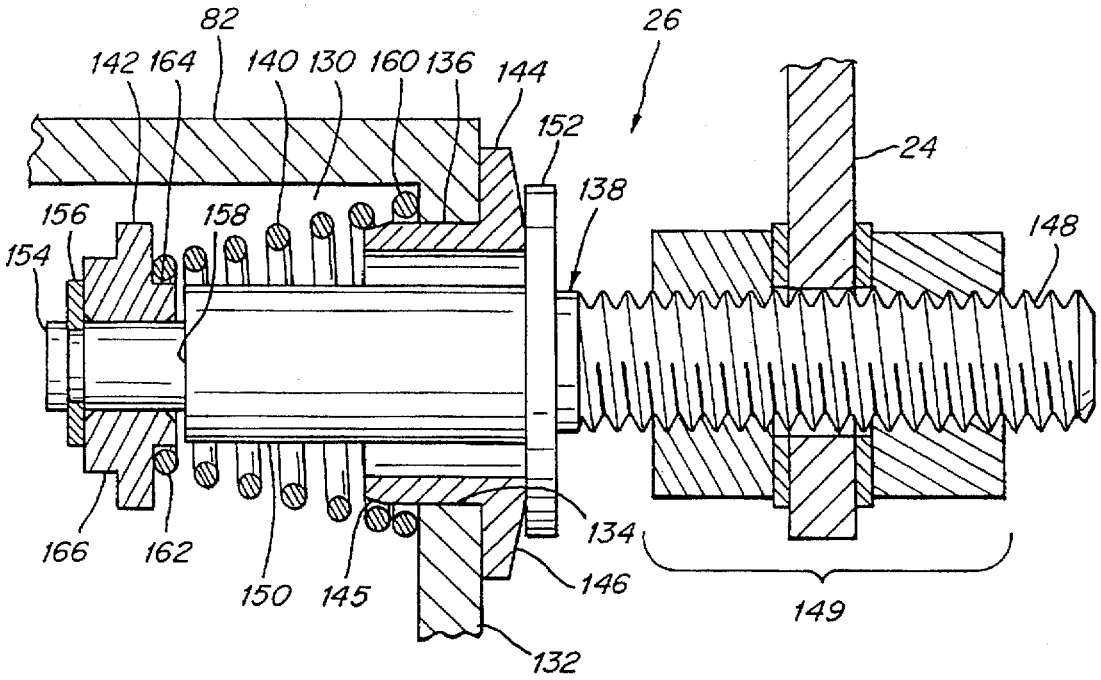
FIG. 5 is an enlarged cross-sectional view of an embodiment of the floating pin joint taken along section line 5—5 of FIG. 4.
Figure 6:
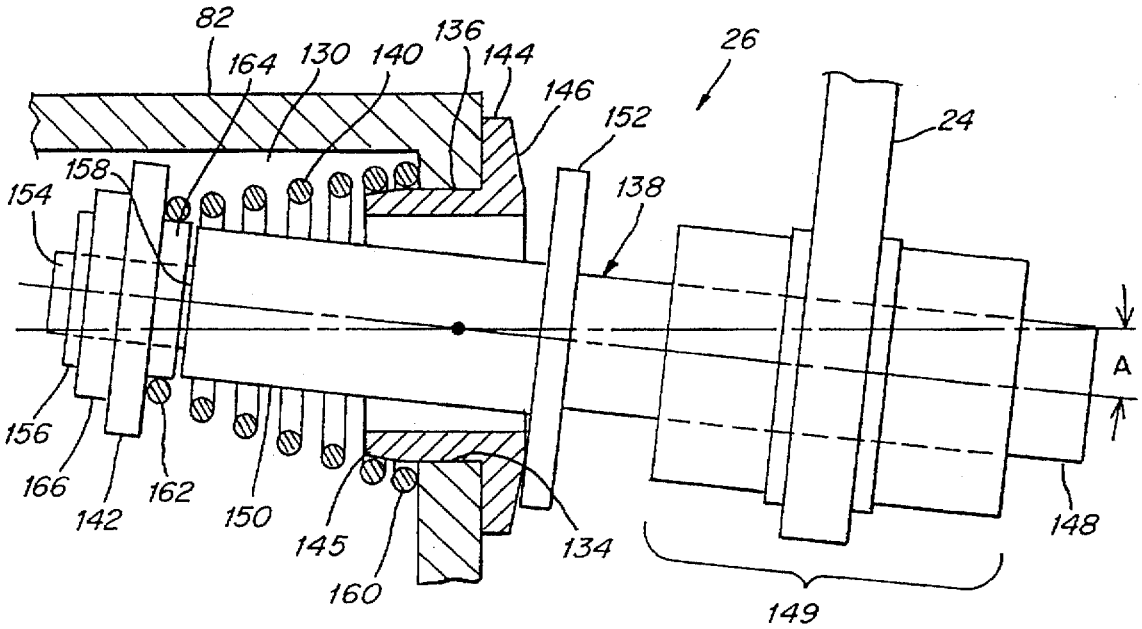
FIG. 6 is a schematic view of FIG. 5 illustrating deflection of the floating pin joint.

As previously discussed and shown in FIGS. 1, 4 and 6, the floating pin joint 26 reduces or substantially eliminates free play in the Z direction to result in more accurate positional measurements, while at the same time allowing radial X, Y, rotational R and pivoting A movements of the joint 26 without impacting the accuracy of the measurements. One embodiment of such a floating pin joint 26 includes a bushing 136, an actuator rod 138, a spring 140 and a retainer 142 as shown in FIGS. 2, 5 and 6. One end of the bushing 136 has an annular member 144 that engages the front wall 132 of the chamber 130 when the bushing 136 is inserted through the mounting hole 134. The bushing 136 is formed so that a rear portion 145 of the bushing 136 extends beyond the front wall 132 and into the chamber 130. The annular member 144 of the bushing 136 has a bearing surface 146 facing outwardly from the front wall 132 to support the actuator rod 138, which is mounted through the bushing 136. The bearing surface 146 should be beveled so as to facilitate the pivoting or coning motion A of the actuator rod 138. Preferably, the bushing 136 is made from an oilite bronze to reduce friction between the bushing 136 and the actuator rod 38, and has a bearing surface 146 with a 10° bevel.

The actuator rod 138 includes a first end 148, a second end 150 and an annular flange 152 disposed between the first end 148 and the second end 150. The first end 148 of the actuator rod 138 attaches to the second component part 24. As illustrated in one embodiment, the first end 148 can be formed with either English or Metric threads and attaches to the second component part 24 using conventional hardware 149, such as nuts and washers. The first end 148, however, can be provided in other configurations that attach to the second component part 24 using other means such as welding or other types of fasteners. The second end 150 of the actuator rod 138 is inserted through the bushing 136 so that the flange 152 engages the bearing surface 146 of the bushing 136. The spring 140 is coaxially placed over the second end 150 of the actuator rod 138 and is placed into compression by the retainer 142 that attaches to the tip 154 of the second end 150 using a fastener 156 such as a retaining ring. The second end 150 is concentric to the first end 148 and has a diameter that is less than the internal diameter of the bushing 136 to allow the actuator rod 138 to radially float X, Y and pivot A within the bushing 136. Preferably, the relative sizes between the bushing 136 and the second end 150 of the actuator rod 138 results in a 0.050 inch radial float. The tip 154 should have a diameter that is less than the second end 150 creating a shoulder 158 which limits the axial movement of the retainer 142 along the tip 154. Preferably, the actuator rod 138 is machined from a stainless steel material as a single part. The actuator rod 138, however, could be manufactured from other materials such as an oxidized metal. Furthermore, the flange 152 could be attached as a separate part using methods such as welding, brazing, etc.

The spring 140 has a first end 160 that is positioned over the rear portion 145 of the bushing which extends beyond the front wall 132 into the chamber 130 and engages the rear surface of the front wall 132. The second end 162 of the spring 140 engages and is compressed by the retainer 142. The retainer 142 has a first shoulder 164 that is approximately the same diameter as the second end 150 of the actuator rod 138 and extends axially into the second end of the spring 140 to retain the spring 140 from moving in a radial direction. The retainer 142 has an overall diameter sufficient to maintain the spring 140 in a compressed state, while at the same time ensuring that the actuator rod 138 can pivot freely without interfering with the chamber walls. The retainer 142 should also have a second shoulder 166 concentric with the first shoulder 164 that allows an assembly tool to grasp the retainer 142 and compress the spring 140 so that the fastener 156 can be attached to the tip 154 of the second end 150. Preferably, the spring 140 is made from a stainless steel wire.

Compressing the spring 140 generates an axial force between the front wall 132 and the retainer 142 that maintains the flange 152 against the bearing surface 146 and reduces or substantially eliminates the free play in the Z direction. As illustrated in the figures, the spring 140 preferably has a conical shape with the second end 162 being smaller in diameter than the first end 160 to allow the actuator rod 138 to pivot or cone more easily and by a greater amount within the same volume than if the spring had a constant diameter. To reduce or substantially eliminate free play in the floating pin joint 26, the spring 140 should have a spring rate that creates a compressive force having a magnitude that maintains the flange 152 against the bearing surface 146 under expected operating conditions. In a preferred embodiment, the spring rate for the conically shaped spring 140 should be approximately 9.3 lbs. per inch at a 0.215 inch deflection.

Having described illustrative embodiments of the invention in detail, those skilled in the art will appreciate that numerous modifications may be made to this embodiment without departing from the spirit of the invention. Therefore, it is intended that the breadth of this invention not be limited to the specific embodiments illustrated and described. Rather, the breadth of the invention is to be determined by the appended claims and their equivalents.

What is claimed is:

1. A floating pin joint for coupling a first member to a second member so that movement of the second member in a predetermined direction causes movement of the first member in the predetermined direction, the first member having a mounting hole thereon, the floating pin joint comprising:

a bushing having a longitudinal axis and including an annular bearing surface disposed at a first end thereof, the bearing surface being transverse to the longitudinal axis, the bushing adapted to be positioned in the mounting hole with the bearing surface facing outwardly from the first member;

an actuator rod including a first portion, a second portion and a flange disposed between the first and second portions, the first portion protruding from the flange to be attached to the second member, the second portion extending from the flange through the bushing with the flange contacting the bearing surface, the actuator rod being movable within the bushing in a direction transverse to the longitudinal axis; and biasing means for maintaining the flange in contact with the bearing surface, the biasing means being attached to the second portion of the rod.

2. The floating pin joint as recited in claim 1, wherein the bearing surface is beveled to allow the actuator rod to pivot relative to the longitudinal axis of the bushing as the flange moves across the bearing surface.

3. The floating pin joint as recited in claim 2, wherein the bearing surface is beveled approximately 10° from a plane that is perpendicular to the longitudinal axis of the bushing.

4. The floating pin joint as recited in claim 1, wherein the first portion of the actuator rod includes threads.

5. The floating pin joint as recited in claim 1, wherein the second portion of the actuator rod has an outer diameter and the bushing has an internal diameter, the outer diameter being less than the internal diameter so that the actuator rod can radially float within the bushing.

6. The floating pin joint as recited in claim 5, wherein the bearing surface is beveled to allow the actuator rod to pivot relative to the longitudinal axis of the bushing as the flange moves across the bearing surface.

7. The floating pin joint as recited in claim 6, wherein the bearing surface is beveled approximately 10° from a plane that is perpendicular to the longitudinal axis of the bushing.

8. The floating pin joint as recited in claim 1, wherein the biasing means includes a spring and a retainer, the retainer attaching the spring to the second portion of the actuator rod.

9. The floating pin joint as recited in claim 8, wherein the spring is disposed about the second portion of the actuator rod and is compressed by the retainer so that a compressive force is generated to maintain the flange in contact with the bearing surface when the second member is moved relative to the first member.

10. The floating pin joint as recited in claim 9, wherein the spring is conical having a first end with a first diameter and a second end with a second diameter, the first diameter being greater than the second diameter, the first end of the spring being disposed about a second end of the bushing opposite the first end of the bushing, the second end of the spring being disposed about a first end of the retainer.

11. A floating pin joint for connecting a linear potentiometer between two component parts of a machine, the floating pin joint comprising:

a bushing that is to be attached to the potentiometer, the bushing having an annular bearing surface facing outwardly from the potentiometer;

an actuator rod including a first portion, a second portion and a flange disposed between the first and second portions, the first portion protruding from the flange to be attached to one of the component parts, the second portion extending from the flange through the bushing with the flange contacting the bearing surface, the actuator rod being movable within the bushing in a direction across the bearing surface;

a spring disposed about the second portion of the actuator rod; and a retainer attached to the second portion of the actuator rod and compressing the spring to urge the flange into contact with the bearing surface.

12. The floating pin joint as recited in claim 11, wherein the bearing surface is beveled to allow the actuator rod to pivot relative to the longitudinal axis of the bushing as the flange moves across the bearing surface.

13. The floating pin joint as recited in claim 12, wherein the bearing surface is beveled approximately 10° from a plane that is perpendicular to the longitudinal axis of the bushing.

14. The floating pin joint as recited in claim 11, wherein the second portion of the actuator rod has an outer diameter and the bushing has an internal diameter, the outer diameter being less than the internal diameter so that the actuator rod can radially float within the bushing.

15. The floating pin joint as recited in claim 14, wherein the bearing surface is beveled to allow the actuator rod to pivot relative to the longitudinal axis of the bushing as the flange moves across the bearing surface.

16. The floating pin joint as recited in claim 15, wherein the bearing surface is beveled approximately 10° from a plane that is perpendicular to the longitudinal axis of the bushing.

17. The floating pin joint as recited in claim 11, wherein the spring is disposed about the second portion of the actuator rod and is compressed by the retainer to generate a compressive force that maintains the flange in contact with the bearing surface.

18. The floating pin joint as recited in claim 17, wherein the spring is conical having a first end with a first diameter and a second end with a second diameter, the first diameter being greater than the second diameter, the first end of the spring being disposed about a second end of the bushing opposite the first end of the bushing, the second end of the spring being disposed about a first end of the retainer.

19. A linear potentiometer for measuring the relative movement between first and second component parts, the potentiometer comprising:

an elongated housing having a longitudinal slot disposed on a wall of the housing, and a longitudinal guide disposed in the housing, the housing being securable to the first component part;

a resistive element mounted in the housing;

a wiper carrier including a sled portion having a first shoe disposed on a first end of the sled portion and a second shoe disposed on a second end of the sled portion, the first and second shoes slidably engaging the guide, an upper portion extending from the sled portion through the slot, and a wiper disposed on the sled portion between the first shoe and the second shoe, the wiper slidably engaging the resistive element;

an actuator drive cover connected to the upper portion of the wiper carrier, the actuator drive cover having a mounting hole on a wall thereof; and a floating pin joint mounted to the actuator drive cover, the floating pin joint including;

a bushing positioned in the mounting hole, the bushing having an annular bearing surface disposed on a first end, the bearing surface facing outwardly from the actuator drive housing;

an actuator rod having a first end, a second end and a flange disposed between the first and second ends, the second end being extended through the bushing so that the flange contacts the bearing surface;

biasing means for maintaining the flange in contact with the bearing surface, the biasing means attached to the second end of the actuator rod; and wherein the first end of the actuator rod connects to the second component part so that movement of the second component part in a predetermined direction causes movement of the wiper carrier along the housing so that the wiper slides along the resistive element.

20. The linear potentiometer as recited in claim 19, further comprising a metal strip retained over the slot using magnetic strips disposed on each side of the slot, the metal strip sliding over the upper portion of the wiper carrier as the wiper carrier travels along the housing.

21. The linear potentiometer as recited in claim 19, wherein the wiper carrier further includes a wiper block detachably connected to the sled portion, the wiper being attached to the wiper block.

22. The linear potentiometer as recited in claim 19, wherein the first shoe is pivotally attached to the sled portion.

23. The linear potentiometer as recited in claim 19, wherein the actuator drive housing includes a chamber disposed at a first end, the chamber having the mounting hole for the floating pin joint.

24. The linear potentiometer as recited in claim 23, wherein the second end of the actuator rod extends into the chamber, the biasing means being disposed in the chamber.

25. The linear potentiometer as recited in claim 24, wherein the biasing means includes a spring positioned approximately coaxial over the second end of the actuator rod, and a retainer attached to the second end of the actuator rod, the retainer compressing the spring against the wall for generating a compressive force that maintains the flange in contact with the bearing surface.

26. The linear potentiometer as recited in claim 25, wherein the bushing has a second end that extends into the chamber and the retainer has a first shoulder disposed at a first end, the second end of the bushing extending into a first end of the spring and the first shoulder of the retainer extending into a second end of the spring.

27. The linear potentiometer as recited in claim 26, wherein the spring is conical having a first diameter at the first end and a second diameter at the second end, the first diameter being greater than the second diameter.

28. The linear potentiometer as recited in claim 26, wherein the retainer has a second shoulder disposed at a second end for receiving an assembly tool to compress the spring.

29. An apparatus, comprising:

a linear potentiometer for measuring relative movement between first and second component part, the potentiometer having a wall, and a floating pin joint mounted to the potentiometer for coupling one of the component parts to the potentiometer, the floating pin joint comprising:

a bearing surface disposed on the wall of the potentiometer and having a hole therethrough;

an actuator rod including a flange affixed thereto, a first portion protruding from one side of the flange to be attached to the one of the component parts, and a second portion protruding from the opposite side of the flange, the actuator rod extending through the hole in the bearing surface and being movably supported with the flange in contact with the bearing surface and a spring attached to the second portion of the actuator rod to urge and maintain the flange in contact with the bearing surface when the actuator rod moves relative to the bearing surface.

30. The floating pin joint as recited in claim 29, wherein the bearing surface is beveled to allow the actuator rod to pivot relative to a longitudinal axis of the hole as the flange moves across the bearing surface.

31. The floating pin joint as recited in claim 30, wherein the bearing surface is beveled approximately 10° from a plane that is perpendicular to the longitudinal axis of the hole.

32. The floating pin joint as recited in claim 29, wherein the first portion of the actuator rod includes threads.

33. The floating pin joint as recited in claim 29, wherein the second portion of the actuator rod has an outer diameter and the hole has an internal diameter, the outer diameter being less than the internal diameter so that the actuator rod can radially float within the hole.

34. The floating pin joint as recited in claim 33, wherein the bearing surface is beveled to allow the actuator rod to pivot relative to a longitudinal axis of the hole as the flange moves across the bearing surface.

35. The floating pin joint as recited in claim 34, wherein the bearing surface is beveled approximately 10° from a plane that is perpendicular to the longitudinal axis of the hole.

36. The floating pin joint as recited in claim 29, further comprising a retainer that attaches the spring to the second portion of the actuator rod.

37. The floating pin joint as recited in claim 36, wherein the spring is disposed about the second portion of the actuator rod and is compressed by the retainer toward the flange so that a biasing force is generated to maintain the flange in contact with the bearing surface when the one of the component parts is moved relative to the other of the component parts.

38. The floating pin joint as recited in claim 37, wherein the spring is conical and has a first end with a first diameter and a second end with a second diameter, the first diameter being greater than the second diameter, the second end of the spring being disposed about a first end of the retainer.

* * * * *